US009266005B2

(12) United States Patent
Stenquist

(10) Patent No.: US 9,266,005 B2
(45) Date of Patent: Feb. 23, 2016

(54) NET WITH A VERTICALLY ADJUSTABLE UPPER EDGE FOR A PLAYING AREA AND A METHOD FOR ADJUSTING THE HEIGHT OF THE UPPER EDGE

(71) Applicant: STONESNET AB, Linköping (SE)

(72) Inventor: Roger Stenquist, Linköping (SE)

(73) Assignee: STONESNET AB, Linköping (SE)

( * ) Notice: Subject to any disclaimer, the term of this patent is extended or adjusted under 35 U.S.C. 154(b) by 0 days.

(21) Appl. No.: 14/404,398

(22) PCT Filed: May 28, 2013

(86) PCT No.: PCT/SE2013/050608

§ 371 (c)(1),
(2) Date: Nov. 26, 2014

(87) PCT Pub. No.: WO2013/180631

PCT Pub. Date: Dec. 5, 2013

(65) Prior Publication Data

US 2015/0148151 A1 May 28, 2015

(30) Foreign Application Priority Data

May 31, 2012 (SE) ..... 1230056

(51) Int. Cl.
*A63B 71/02* (2006.01)
*A63B 61/00* (2006.01)
(Continued)

(52) U.S. Cl.
CPC ..... *A63B 71/02* (2013.01); *A63B 61/00* (2013.01); *A63B 67/002* (2013.01); *A63B 61/003* (2013.01); *A63B 61/02* (2013.01); *A63B 2225/093* (2013.01); *A63B 2243/0083* (2013.01)

(58) Field of Classification Search
CPC ..... A63B 69/00; A63B 67/00; A63B 71/02; A63B 61/00; A63B 67/002
USPC ..... 473/474
See application file for complete search history.

(56) References Cited

U.S. PATENT DOCUMENTS

D14,442 S 11/1883 Hunziker
843,326 A 2/1907 Chapin
(Continued)

FOREIGN PATENT DOCUMENTS

DE 3523568 A1 1/1987
DE 3823570 A1 1/1990
(Continued)

OTHER PUBLICATIONS

PCT/ISA/210—International Search Report—August 20, 2013 (Issued in PCT/SE2013/050608).
(Continued)

*Primary Examiner* — Gene Kim
*Assistant Examiner* — Jeffrey Vanderveen
(74) *Attorney, Agent, or Firm* — Venable LLP; Eric J. Franklin

(57) ABSTRACT

A net includes lower fixed and upper vertically adjustable parts. The net parts extend across a playing area. Ends of the net parts are fastened to posts at sides of the playing area. The lower net part is fixedly mounted at a lower post part. The upper net part is doubly folded along a line along a longitudinal direction, forming a fold along the line. The upper net part exhibits a downwardly-hanging portion on each side of the fold. The ends of the upper net part are fastened to a vertically adjustable upper post part. The fold of the upper net part is arranged across the lower net part in a longitudinal direction with a portion hanging down on each side of the lower net part, so that the upper net part at least between a lower part of the hanging portions encloses an upper part of the lower net part.

9 Claims, 4 Drawing Sheets

(51) Int. Cl.
*A63B 67/00* (2006.01)
*A63B 61/02* (2006.01)

(56) References Cited

U.S. PATENT DOCUMENTS

| | | | | |
|---|---|---|---|---|
| 1,641,246 | A | 9/1927 | Bassford | |
| 1,896,835 | A | 2/1933 | Bunker | |
| 1,940,595 | A | 12/1933 | Johnson | |
| 1,959,573 | A | 5/1934 | Dieball | |
| 1,998,454 | A | 4/1935 | Gordon | |
| 2,615,715 | A | 10/1952 | Moore | |
| 3,193,255 | A | 7/1965 | Burdett | |
| 3,195,864 | A | 7/1965 | Case | |
| 3,689,067 | A * | 9/1972 | Bramley | D04H 3/045 156/202 |
| 4,122,451 | A | 10/1978 | Senoh | |
| 4,135,716 | A | 1/1979 | Ginsburg | |
| 4,153,247 | A | 5/1979 | Burns | |
| 4,204,679 | A | 5/1980 | Kreuzman | |
| 4,243,221 | A | 1/1981 | Ferreira-Godinho | |
| 4,369,953 | A | 1/1983 | Greiner et al. | |
| 4,415,163 | A | 11/1983 | Schoenig | |
| 4,444,397 | A | 4/1984 | Kaburagi et al. | |
| 4,717,157 | A | 1/1988 | Smith | |
| 4,720,112 | A | 1/1988 | Stettner et al. | |
| 4,830,382 | A | 5/1989 | Wheeler | |
| 4,852,876 | A * | 8/1989 | Scioscia | A63B 61/006 473/459 |
| 4,886,268 | A | 12/1989 | Langslet | |
| 4,895,366 | A | 1/1990 | Bartasius | |
| 4,968,042 | A | 11/1990 | Stewart | |
| 4,993,719 | A | 2/1991 | Hernandez | |
| 5,320,344 | A | 6/1994 | Henderson | |
| 5,344,157 | A | 9/1994 | McCord | |
| 5,358,257 | A | 10/1994 | Pardi | |
| 5,393,051 | A | 2/1995 | Merino et al. | |
| 5,827,137 | A | 10/1998 | Ishino | |
| 6,248,030 | B1 | 6/2001 | Pierce | |
| D465,286 | S | 11/2002 | Gregori | |
| D470,598 | S | 2/2003 | Schneider et al. | |
| 6,758,770 | B2 | 7/2004 | Chandronnait | |
| 6,802,789 | B1 * | 10/2004 | Ishino | A63B 69/0095 273/401 |
| D507,618 | S | 7/2005 | Scarpa, III | |
| 6,926,626 | B2 | 8/2005 | Scarpa, III | |
| 7,410,431 | B2 | 8/2008 | Underwood | |
| 7,429,225 | B1 | 9/2008 | Shull | |
| 7,559,860 | B2 | 7/2009 | Underwood | |
| 7,731,610 | B2 | 6/2010 | Im | |
| D621,956 | S | 8/2010 | Preston | |
| 7,972,226 | B2 | 7/2011 | Underwood | |
| 8,435,141 | B2 | 5/2013 | Harris et al. | |
| D710,563 | S | 8/2014 | Panzer et al. | |
| 8,864,110 | B2 | 10/2014 | Xu | |
| D717,471 | S | 11/2014 | Donnelly et al. | |
| 2002/0065153 | A1 | 5/2002 | Bertrand | |
| 2005/0087733 | A1 | 4/2005 | Weitzel | |
| 2008/0011994 | A1 | 1/2008 | Howe et al. | |
| 2011/0081995 | A1 | 4/2011 | Cusimano | |
| 2011/0224031 | A1 | 9/2011 | Underwood | |
| 2015/0041742 | A1 | 2/2015 | Xu et al. | |

FOREIGN PATENT DOCUMENTS

| | | | |
|---|---|---|---|
| DE | 4019610 | A1 | 11/1991 |
| DE | 4105626 | A1 | 12/1992 |
| DE | 9309430.2 | U1 | 10/1993 |
| DE | 29818966 | U1 | 3/1999 |
| DE | 20204941 | U1 | 10/2002 |
| DE | 20210256 | U1 | 1/2003 |
| DE | 202010000192 | U1 | 7/2010 |
| EP | 0838246 | B1 | 12/2004 |
| FR | 784191 | | 7/1935 |
| FR | 2424592 | | 11/1979 |
| FR | 2750342 | A1 | 1/1998 |
| FR | 2775194 | A1 | 8/1999 |
| FR | 2799657 | A1 | 4/2001 |
| GB | 290394 | | 5/1928 |
| GB | 2172207 | A | 9/1986 |
| GB | 2461942 | A | 1/2010 |
| GB | 2464298 | B | 4/2011 |
| JP | 51-135645 | U | 11/1976 |

OTHER PUBLICATIONS

Office Action Issued in U.S. Appl. No. 29/470,237—June 18, 2015.
Office Action Issued in U.S. Appl. No. 29/470,246—June 19, 2015.

* cited by examiner

NET WITH A VERTICALLY ADJUSTABLE UPPER EDGE FOR A PLAYING AREA AND A METHOD FOR ADJUSTING THE HEIGHT OF THE UPPER EDGE

CROSS-REFERENCE TO RELATED APPLICATIONS

This application claims priority to Swedish patent application 1230056-2 filed 31 May 2012 and is the national phase under 35 U.S.C. §371 of PCT/SE2013/050608 filed 28 May 2013.

TECHNICAL FIELD

The present invention relates to a net that is used in ball games on a playing area, such as primarily tennis, but also a net that is used for other types of ball sports.

BACKGROUND OF THE INVENTION

As from the year 2012, new rules for tennis games for young participants are being internationally introduced. Thus, in connection with training and playing, the young participants will be divided into different age groups, 5-8 years, 8-10 years, 9-10 years and those above the age of 11. These new rules imply, for example, that the different age groups will play under different conditions with regard to: the size of the racket, the hardness and hence speed of the ball, the size of the court and the height of the net.

In these contexts, the arrangement of the height of the net for different age groups is a factor that is difficult or laborious. At one and the same court, it may occur that young participants of various age groups and also senior players alternate with each other and have different playing-times. This may require a complicated adjustment of the height of the net which for the moment is to be adapted to the relevant category of players. One way of arranging this is to replace a net for the last playing category of players with a net adapted to the players that will use the court during the next period of time. Another way of achieving the height adjustment is to quite simply vary the height of the upper net edge above the ground by moving the whole net upwards or downwards by using existing hoisting and tensioning devices which are arranged at the posts which stretch the net at the ends thereof. A disadvantage of varying the height of the net in the last-mentioned way is that a traditional net in the raised position may let through balls below the net, since the net does not reach down to the ground in the raised position.

U.S. Pat. No. 4,852,876 discloses a solution for arranging a net with a vertically adjustable (i.e. raisable and lowerable) upper edge in a net for a tennis court. According to this solution, an upper auxiliary net is arranged. This auxiliary net has an upper longitudinal edge and a lower longitudinal edge, where the upper and lower longitudinal edges are fixed to auxiliary posts which may be hoisted, in the vertical direction, along fixed posts for the net at the two opposite sides of the court. Between the fixed poles, a lower fixed net is placed and stretched. The upper auxiliary net is arranged such that, when hoisted upwards or downwards, it runs parallel to the fixed net along one side thereof. By hoisting it upwards or downwards, the upper auxiliary net may be arranged with the upper longitudinal edge to a desired total height for the whole net. A disadvantage of this arrangement is that balls that are captured by the upper auxiliary net have a tendency to fall down between the upper auxiliary net and the lower fixed net, where these two parts of the net overlap.

No international standard regulating the arrangement of a vertically adjustable net has as yet been adopted.

DESCRIPTION OF THE INVENTION

The present invention relates to a net with a vertically adjustable upper edge that is useful primarily for a playing area for tennis (i.e. a court). However, the invention may be used also for playing areas for other types of ball games.

The net according to the invention consists of a lower fixed net part and an upper net part that is arranged so as to be vertically adjustable. The lower net part is fixed at both its short sides to a lower part of post parts that are fixed to the sides of the playing area. The post parts, to which the lower net part is fastened, are fixed post parts positioned on the playing area according to the rules of the game. The upper net part is doubly folded along a line along its longitudinal direction, whereby a fold is formed along said line. When said fold of the upper net part is stretched freely along the fold, both sides of the fold will exhibit a downwardly-hanging portion of this upper net part, here referred to as net portions. Thus, in cross section, the upper net part will be represented as a V turned upside-down, where the fold of the upper net part corresponds to the tip of the letter V and the two parts hanging down correspond to the stems of the letter V turned upside-down.

According to one aspect of the invention, the upper net part is fixed by its short ends to cylinders running telescopically in the fixed post parts. These cylinders may also be designated upper post parts displaced axially in relation to the fixed post parts.

The upper net part is attached to the cylinders in such a way that the fold will be located in the plane of the lower net part and above the upper longitudinal edge of the lower net part. Further, the downwardly-hanging net portions of the upper net part are arranged such that the lower longitudinal edges of these two net portions will be located on respective sides of the lower net part. In this way, the upper net part will be arranged in a vertically adjustable manner in that said cylinders, to which the upper net part is fastened, may be displaced in the vertical direction along the fixed post parts to which the lower net part is fastened.

By the arrangement described, thus, the upper net part is able to run in the vertical direction and on both sides of the lower net part. Further, the upper net part will cover the upper longitudinal edge of the lower net part on both sides thereof. This arrangement of the cooperation of the two net parts implies that balls being hit against and stopped by the net cannot fall down between the two net parts.

A band, usually white, is folded across the fold of the upper net part and is sewn or otherwise fastened on both sides of the fold, thus forming a channel immediately below the fold line of the band. An upper cable or the like is running in said channel. Lower cables, or the like, are arranged in a similar manner at the lower longitudinal edges of both downwardly-hanging net portions. The upper cable is fixed to upper fixing points of the movable cylinders, whereas the lower cables are fixed to lower fixing points of the cylinders movable along the lower post parts. The lower fixing points are preferably arranged at a horizontal distance from each other in order to separate, to some extent, the downwardly-hanging net portions. By displacing the movable cylinder in the vertical direction along the fixed post parts, the upper net part may thus be raised or lowered more or less down over the lower net part and, with at least the lower parts of their net portions, cover the lower net part along at least the upper part thereof. Since the band that is folded across the upper longitudinal edge of the upper net part compresses this along that part which is covered by the band, a cross section of the upper net part will have a cross section that resembles a tuning fork for tuning a musical instrument.

A cable extending along the net is arranged inside the fold of the upper net part and is fixed, at its respective ends, to an upper point of the upper post part, which is axially displaceable in the vertical direction in relation to the fixed post part.

Lower cables are adapted to extend along the lower longitudinal edges of the net portions hanging down from the fold, whereby the respective ends of said cables are fixed to a lower point of the upper post part.

The ends of the lower cables at a short side of the downwardly-hanging net portions are fixed to said upper post part at fixing points which are separated from each other and located on respective sides of a plane through the lower fixed net.

To sum up, with respect to the posts which support the net, it may be said that these consist of at least two parts, one lower fixed post part supporting the lower net part, and one upper post part movable in the vertical direction and supporting the upper net part, whereby the upper edge of the upper net part may be raised or lowered. Preferably, the upper post part is arranged as an essentially tubular, predetermined profile which can be displaced in the vertical direction outside the lower post part. However, in an alternative embodiment, the upper post part may be adapted to be displaceable inside the lower port part, which in this alternative is tubular with a desired cross-section profile. In a variant with the upper post part as the outer tubular part, a slit is provided in which the rope supporting the lower net part may run freely when the upper post part is to be displaced in the vertical direction. In the other variant with the lower post part as the outer tubular part, slits are provided in which the ropes supporting the upper net part may run freely when the upper post part is to be displaced in the vertical direction Further, the post may be adapted to

- be provided with predefined height positions for the upper post part,
- be provided with a lock for fixing the upper post part in the predefined height positions,
- have devices integrated with the post for cable tensioning for tensioning both the lower and upper net parts, or, alternatively, a fixed cable-lock function for one of the posts in a pair of posts, since a device for cable tensioning only need to occur in one of the posts in a pair of posts.

DESCRIPTION OF EMBODIMENTS

In the following a number of embodiments of the invention will be described with reference to the accompanying drawings. The drawings show only schematically the principle of the device and do not claim to show any proportions between different elements thereof according to scale.

Figure 1:
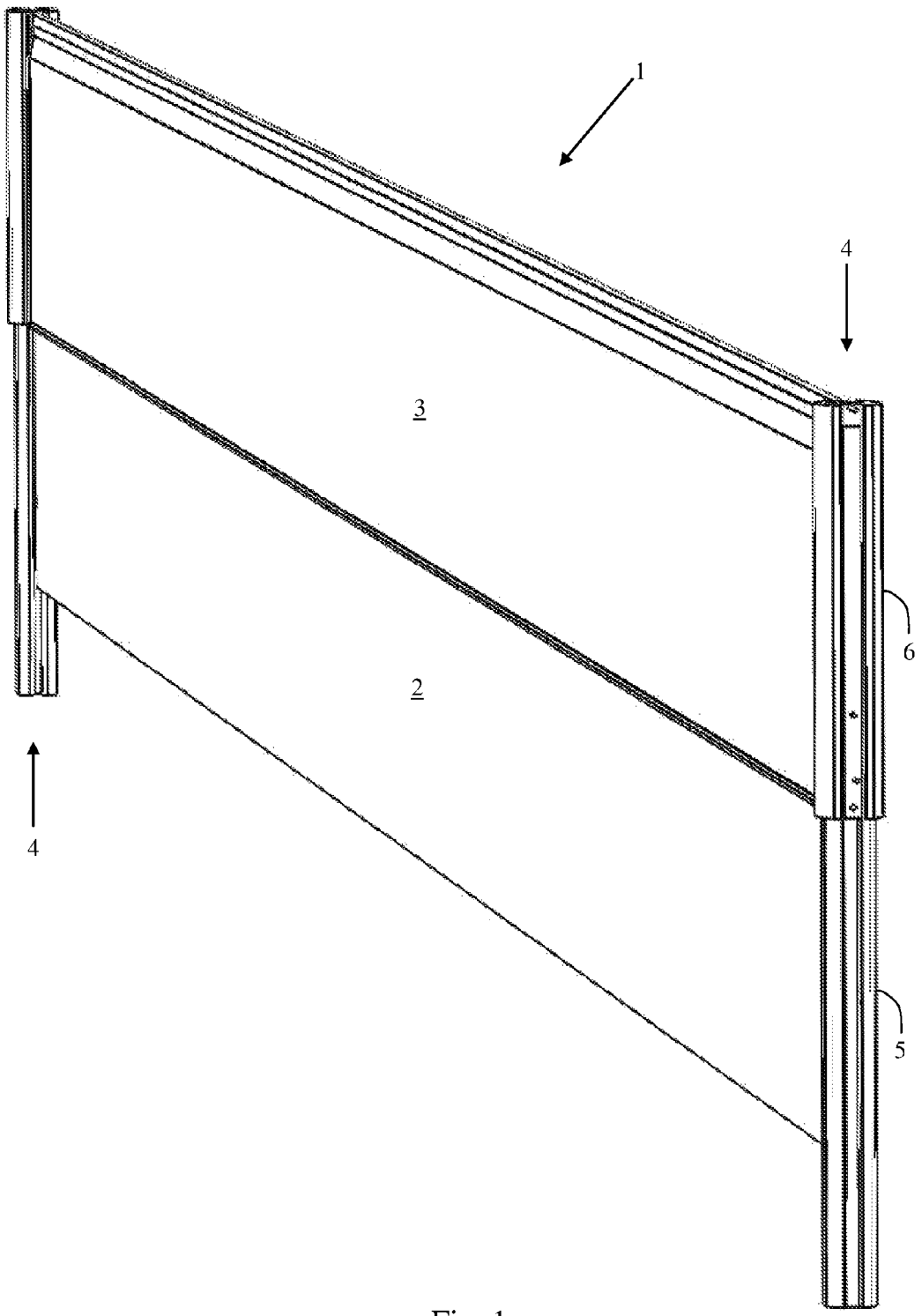
FIG. 1 shows a schematic representation of a perspective view of the net according to the invention with its upper and lower net parts fastened to posts at the short ends of the net parts.

FIG. 1 shows the net 1 according to one aspect of the invention. The net 1 consists of a lower fixed net part 2 and an upper net part 3 which is displaceable, in its entirety, in the vertical direction.

The two net parts 2 and 3, at their respective short ends, are stretched and fastened between posts 4 positioned according to the rules that apply for the game in which the net 1 is used, usually at the long sides of a playing area. The posts 4 are divided into a fixed post part 5 and a cylinder 6 capable of running along the fixed post part 5 at the upper part thereof. In the example shown, the cylinder 6 is able to run externally of the fixed post part 5. However, there is nothing preventing the cylinder 6 from running inside the fixed post part 5 in an alternative embodiment.

Figure 2:
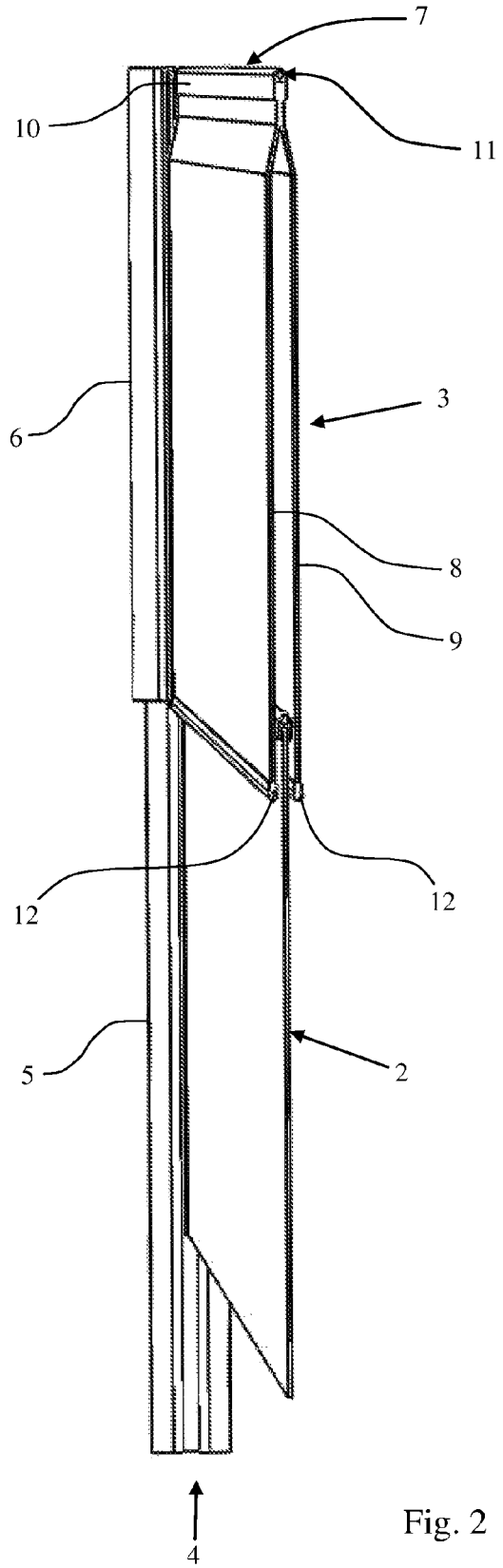
FIG. 2 illustrates, in a cross section of the net according to the invention, how the upper net part and the lower net part cooperate and form the vertically adjustable net.

As shown in FIG. 2, the lower net part 2 is fixed to the lower part of the fixed post part 5. Along the upper part of the fixed post part 5, the cylinder 6 is able to run and be adjusted at the desired height by means of a hoisting device (not shown). Hoisting devices are known and are not described here. The attachment of the fixed net to the post parts 5 is made in conventional manner by, for example, cables that are stretched along the upper and lower longitudinal edges of the lower net part 2 and where the ends of the cables are fixed at the respective end to the post parts 5. This causes the lower net part 5 to be stretched out so as to be flat and to have its lower longitudinal edge towards or near the ground.

The upper net part 3 is doubly folded lengthwise and hence exhibits a fold 7, thus forming two downwardly-hanging net portions 8 and 9, respectively, adapted to hang down over and to cover an upper part of the lower net part 2 on both sides thereof. Across the fold 7 and folded down on both sides of the upper longitudinal edge—formed along the fold 7—of the upper net part 3, a band 10 is applied by sewing or in some other manner. The band 10 encloses a channel thus formed, into which an upper cable 11 is passed. By means of this cable 11, the upper longitudinal edge of the upper net part may be clamped between the posts 4 in that the two ends of the cable are clamped into and are fixed to the uppermost part of the cylinders 6. In a corresponding manner, a lower cable 12 is passed into a lower longitudinal edge in each of the downwardly-hanging net portions 8, 9 of the upper net part 3. These lower cables 12 are fixed to a lower part of the cylinder 6 at a certain distance from each other so that the downwardly-hanging net portions 8, 9 are brought to appear somewhat separated from each other in order thus to be able to enclose, at their lower parts, an upper part of the lower net part 2, which is clearly illustrated in FIG. 2.

Figure 3:
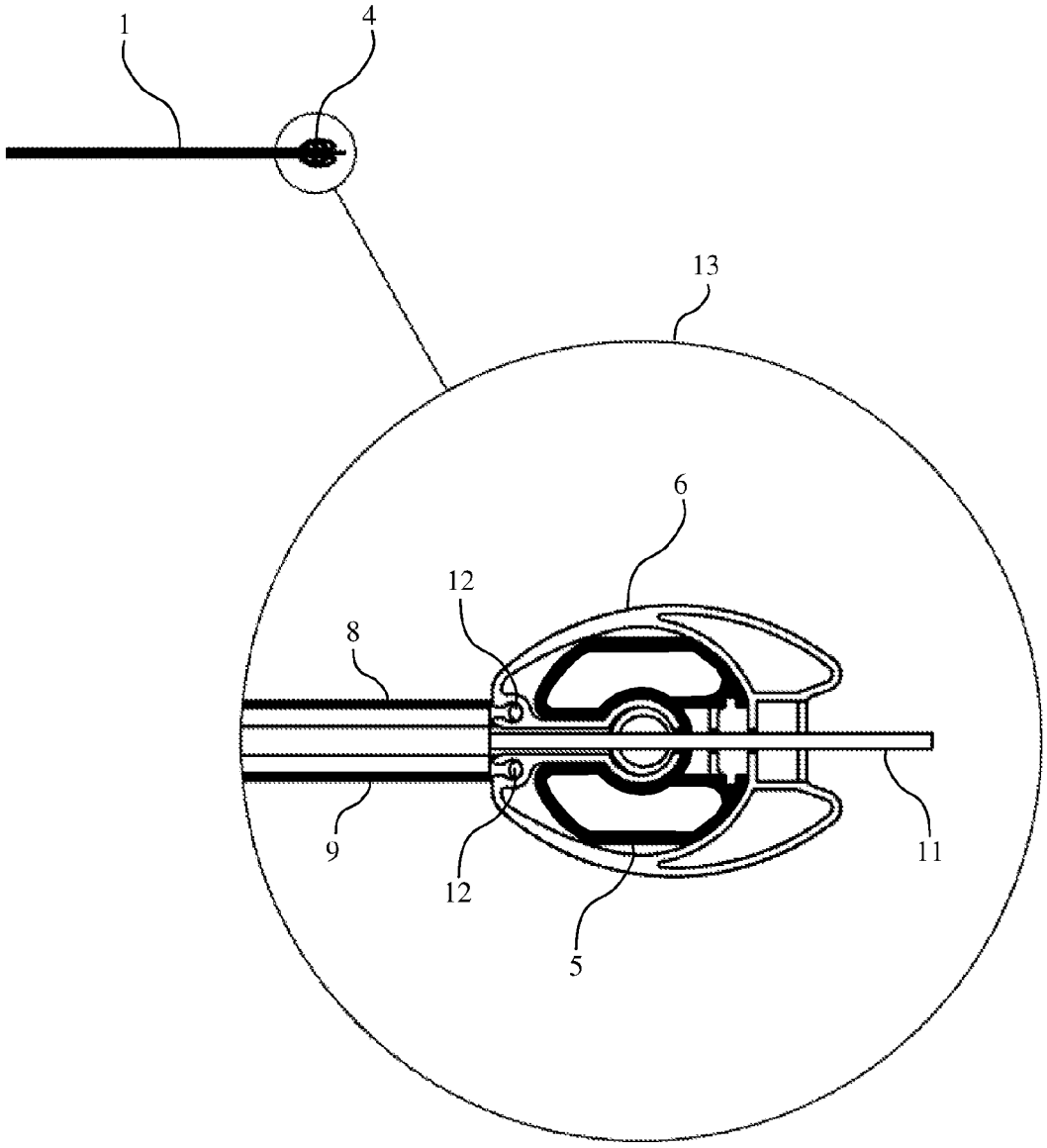
FIG. 3 shows schematically a cross section in an upper part of a post to which the net is fastened.
Figure 4A:
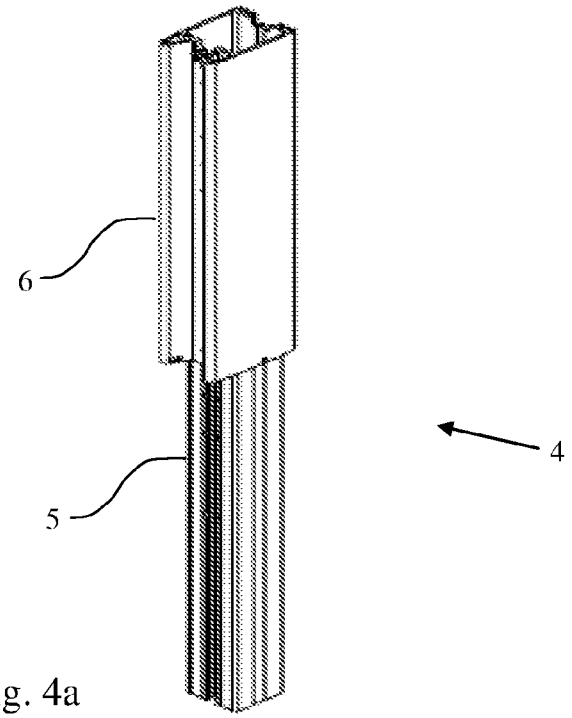
FIGS. 4*a* and 4*b* shows a post with an alternative profile of the upper and lower post parts, and where the FIG. 4*b* is a cross section of the upper part of the post.
Figure 4B:
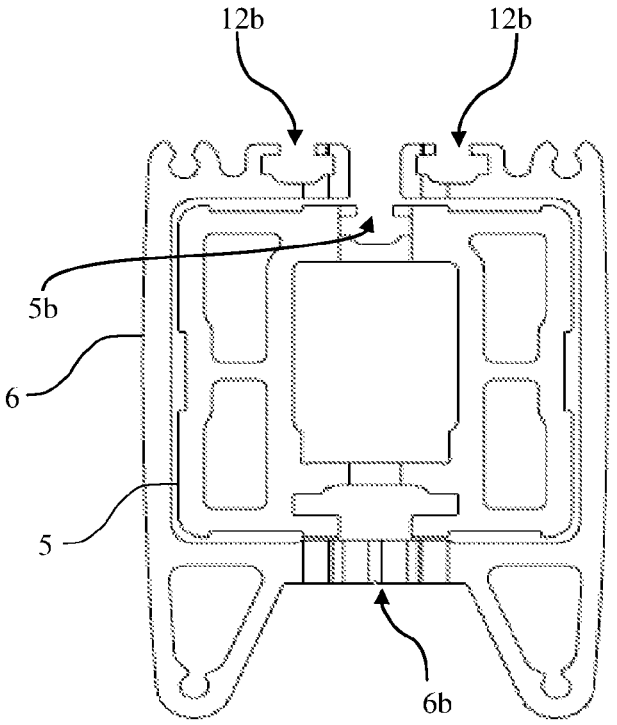

A post 4, to which the net 1 is stretched, is shown in FIG. 3, and in an alternative embodiment in FIGS. 4*a* and 4*b*. In an upper part of the figure, a plan view from above illustrates how the net 1 is fixed to the post 4. The post 4 is encircled by a circle 13, which is shown enlarged in the lower part of the figure. This shows that the lower post part 5 is in the form of a profile, for example made of a metal of some kind and essentially cylindrical. Further, the post part 5, at least in its upper part, is slotted to allow the upper cable 11 of the upper net part 3 to be displaced in the vertical direction when the total height of the net 1 above the ground is to be adjusted. Thus, the upper part of the post part 5 exhibits a certain length with a slot 5*b* for the upper cable, which is fixed and stretched by stretching means on the backside of upper post part 6 at positions 6*b*

The cables 12 extending along the lower longitudinal edges of the two net portions 8, 9 of the upper net part 3 are fastened to slots 12*b* in the cylinder 6 at an edge facing the net 1.

Arrangements for hoisting the cylinder 6 in relation to the post part 5 are not shown.

DEFINITIONS

The cylinder 6, which is telescopically displaceable in the fixed post 4, may consist of a tube, a post, a rod, a casing or any other arbitrary stiff profile and may be adapted to move along the fixed post either internally of or externally of said post. With regard to the cylinder, it is also to be understood that this does not have to be circular in cross section. The cross section of a cylinder may be described by an arbitrary closed curve, with the exception, of course, of those cross sections of the cylinder that comprise a slit where a cable shall be able to run freely when raising or lowering the total net height.

The concept cable shall mean any type of wire-like device capable of being tensioned and capable of absorbing the forces that arise when a net according to the invention is stretched between the posts (4) by means of such a cable. Thus, for example, a chain, a rope, a wire, a coil spring and the like could be used as equivalents to a cable.

The invention claimed is:

1. A net for a playing area, the net comprising:

a lower fixed net part, an upper vertically adjustable net part, wherein both the lower net part and the upper net part have an extension across a playing area, and posts placed at the sides of the playing area, wherein ends of the lower net part and upper net part are fastened to the posts, whereby the lower net part is fixedly mounted at a lower part of said posts, wherein the upper net part is doubly folded along a line along a longitudinal direction of the upper net part, so that a fold is formed along said line and so that the upper net part exhibits a downwardly-hanging net portion on each side of the fold, wherein the posts comprise a vertically adjustable upper part to which the ends of the upper net part are fastened, wherein the vertically adjustable upper part is configured to move the upper net part between a raised position and a lowered position, wherein the fold of the upper net part is arranged across the lower net part in a longitudinal direction of the lower net part with a net portion hanging down on each side of the lower net part in the raised position and lower position so that the upper vertically adjustable net part, at least between a lower part of hanging net portions of the vertically adjustable net, encloses an upper part of the lower net part with the upper part in the raised position.

2. The net according to claim 1, wherein the fold of the upper net part is arranged in a same plane as a plane through the lower net part.

3. The net according to claim 1, wherein a cable in an upper longitudinal edge and a lower longitudinal edge of the lower net part is fixed to fixed post parts of the posts so that the lower longitudinal edge adjoins a ground surface below the net.

4. The net according to claim 2, further comprising:

a cable arranged inside the fold of the upper net part, wherein respective ends of the cable are fastened to an upper point of an upper post part which is axially displaceable in the vertical direction in relation to a fixed post part.

5. The net according to claim 4, further comprising:

lower cables arranged to run along lower longitudinal edges of the net portions hanging down from the fold, whereby the respective ends of said lower cables are fixed to a lower point of the upper post part.

6. The net according to claim 5, wherein the ends of the lower cables at a short side of the downwardly-hanging net portions are fastened to said upper post part at fixing points which are separated from each other and located on respective sides of a plane through the lower fixed net part.

7. The net according to claim 1, wherein the net is a tennis net.

8. A method for adjusting a height of an upper edge in a net at a playing area, the method comprising:

stretching a lower net part between a lower part of posts supporting said net, stretching an upper net part between an upper part of said posts, wherein the upper net part is doubly folded with downwardly-hanging net portions hanging down on respective sides of and partially covering the lower net part, and adjusting the upper net part relative to the lower net part in a vertical direction by vertically displacing the upper part of said posts, thereby causing the respective sides of the upper net part to slide past the lower net part such that with the upper net part in a raised position the upper net part encloses an upper part of the lower net part at least between a lower part of hanging net portions of the vertically adjustable net.

9. The net according to claim 1, wherein lower longitudinal ends of the upper net portion are separated from each other.

* * * * *